US008242990B2

(12) United States Patent
Song et al.

(10) Patent No.: US 8,242,990 B2
(45) Date of Patent: Aug. 14, 2012

(54) LIQUID CRYSTAL DISPLAY HAVING FUNCTION OF SUPPRESSING STAIN AND METHOD OF DRIVING THE SAME

(75) Inventors: Hongsung Song, Gumsi-si (KR); Woongki Min, Daegu (KR); Yonggi Son, Milyang-si (KR); Suhyuk Jang, Daegu (KR)

(73) Assignee: LG Display Co., Ltd., Seoul (KR)

( * ) Notice: Subject to any disclaimer, the term of this patent is extended or adjusted under 35 U.S.C. 154(b) by 873 days.

(21) Appl. No.: 12/318,283

(22) Filed: Dec. 23, 2008

(65) Prior Publication Data

US 2009/0267878 A1 Oct. 29, 2009

(30) Foreign Application Priority Data

Apr. 29, 2008 (KR) ..... 10-2008-0039877

(51) Int. Cl.
*G09G 3/36* (2006.01)

(52) U.S. Cl. ..... 345/87; 345/96; 345/99

(58) Field of Classification Search ..... 345/87, 345/96, 99
See application file for complete search history.

(56) References Cited

U.S. PATENT DOCUMENTS

2006/0007091 A1* 1/2006 Yang et al. ..... 345/89
2008/0043004 A1* 2/2008 Lee ..... 345/204

FOREIGN PATENT DOCUMENTS

JP 09292871 A * 11/1997

* cited by examiner

*Primary Examiner* — Alexander S Beck
*Assistant Examiner* — Joseph Pena
(74) *Attorney, Agent, or Firm* — McKenna Long & Aldridge, LLP

(57) ABSTRACT

A liquid crystal display and a method of driving the same are disclosed. The liquid crystal display includes a timing signal multiplying circuit generating a first timing signal and a second timing signal whose frequency is higher than a frequency of the first timing signal, a frame counter detecting a multiplied frame period to be driven at the frequency of the second timing signal, a data processing circuit allowing a frequency of digital data output during the multiplied frame period to be higher than a frequency of the digital data output during a frame period except the multiplied frame period, a timing control signal generating circuit generating a polarity control signal for controlling polarities of the digital data, and a polarity control signal inverting circuit that increases a frequency of the polarity control signal during the multiplied frame period to generate an inverse polarity control signal.

8 Claims, 13 Drawing Sheets

LIQUID CRYSTAL DISPLAY HAVING FUNCTION OF SUPPRESSING STAIN AND METHOD OF DRIVING THE SAME

This application claims the benefit of Korea Patent Application No. 10-2008-0039877 filed on Apr. 29, 2008, which is incorporated herein by reference for all purposes as if fully set forth herein.

BACKGROUND OF THE INVENTION

1. Field of the Invention

The present invention relates to a liquid crystal display and a method of driving the same.

2. Discussion of the Related Art

Active matrix type liquid crystal displays display a moving picture using a thin film transistor (TFT) as a switching element. The active matrix type liquid crystal displays have been implemented in televisions as well as in display devices in portable devices, such as office equipment and computers, because of the thin profile of the active matrix type liquid crystal displays. Accordingly, cathode ray tubes (CRT) are being rapidly replaced by the active matrix type liquid crystal displays.

If a DC voltage is applied to a liquid crystal layer of a liquid crystal display for a long time, ions in the liquid crystal layer are polarized based on polarities of the liquid crystals. Further, as time passes, the amount of ions accumulated in the liquid crystal layer increases. An increase in the amount of accumulated ions degrades an alignment layer and alignment characteristics of the liquid crystals. In other words, the application of the DC voltage to the liquid crystal layer for a long time causes stains on the display screen, and the size of the stains increases as time elapsed. To solve the stain problem, a liquid crystal material with a low dielectric constant has been developed, or a method for improving an alignment material or an alignment method has been attempted. However, it takes a long time and a great expense to develop a material used in the method. Further, the use of the liquid crystal material with the low dielectric constant may reduce drive characteristics of the liquid crystal. According to the experimental findings, as the amount of impurities ionized inside the liquid crystal layer increases and an acceleration factor becomes large, an appearance time of the stains becomes more rapid. The acceleration factor may include temperature, time, a DC drive of the liquid crystal, and the like. For example, when a period during which a DC voltage of the same polarity is applied to the liquid crystal layer becomes longer at a high temperature, the stains worsen and the appearance time of the stains becomes rapider. Because the stains non-uniformly appear between display panels manufactured through the same manufacture line, the stain problem cannot be solved only a development of new material or an improvement of process.

SUMMARY OF THE INVENTION

Accordingly, embodiments of the present invention provide a liquid crystal display and a method of driving the same capable of suppressing a staining phenomenon caused by the polarization and accumulation of ions.

Additional features and advantages of the exemplary embodiments will be set forth in the description which follows, and in part will be apparent from the description, or may be learned by practice of the exemplary embodiments. These and other advantages of the exemplary embodiments will be realized and attained by the structure particularly pointed out in the written description and claims hereof as well as the appended drawings.

To achieve these and other advantages and in accordance with the purpose of embodiments, as embodied and broadly described, a liquid crystal display comprises a liquid crystal display panel including a plurality of liquid crystal cells arranged at crossings of a plurality of data lines and a plurality of gate lines in a matrix format, a timing signal multiplying circuit that generates a first timing signal and a second timing signal whose frequency is higher than a frequency of the first timing signal, a frame counter that detects a multiplied frame period to be driven at the frequency of the second timing signal, a data processing circuit that outputs digital data and allows a frequency of the digital data output during the multiplied frame period to be higher than a frequency of the digital data output during a frame period except the multiplied frame period, a timing control signal generating circuit that generates a polarity control signal for controlling polarities of the digital data, a polarity control signal inverting circuit that increases a frequency of the polarity control signal during the multiplied frame period to generate an inverse polarity control signal, a data drive circuit that converts the digital data into a data voltage and controls a polarity of the data voltage in response to the inverse polarity control signal, and a gate drive circuit that supplies gate pulses to the gate lines.

During the multiplied frame period, the data processing circuit outputs digital average data as an average value of data of a previous frame period, and then outputs digital video data to be displayed during a current frame period.

During the multiplied frame period, the data processing circuit outputs digital average data as an average value of data of a current frame period, and then outputs digital video data to be displayed during the current frame period.

During the multiplied frame period, the data processing circuit again outputs digital video data, that was output during a previous frame period, and then outputs digital video data to be displayed during a current frame period.

The data processing circuit successively outputs two times digital video data to be displayed during a current frame period during the multiplied frame period.

During the multiplied frame period, each of the liquid crystal cells is charged to the data voltage with a polarity opposite a polarity of the data voltage, to which the liquid crystal cells were charged during a previous frame period, and then is charged to the data voltage with the same polarity as the polarity of the data voltage of the previous frame period.

In another aspect, a method of driving a liquid crystal display including a liquid crystal display panel having a plurality of liquid crystal cells arranged at crossings of a plurality of data lines and a plurality of gate lines in a matrix format, the method comprises generating a first timing signal and a second timing signal whose a frequency is higher than a frequency of the first timing signal, detecting a multiplied frame period to be driven at the frequency of the second timing signal, outputting digital data and allowing a frequency of the digital data output during the multiplied frame period to be higher than a frequency of the digital data output during a frame period except the multiplied frame period, generating a polarity control signal for controlling polarities of the digital data, increasing a frequency of the polarity control signal during the multiplied frame period to generate an inverse polarity control signal, converting the digital data into a data voltage and controls a polarity of the data voltage in response to the inverse polarity control signal, and supplying gate pulses to the gate lines.

It is to be understood that both the foregoing general description and the following detailed description are exemplary and explanatory and are intended to provide further explanation of embodiments of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Reference will now be made in detail to embodiments of the present invention examples of which are illustrated in the accompanying drawings.

Figure 1:
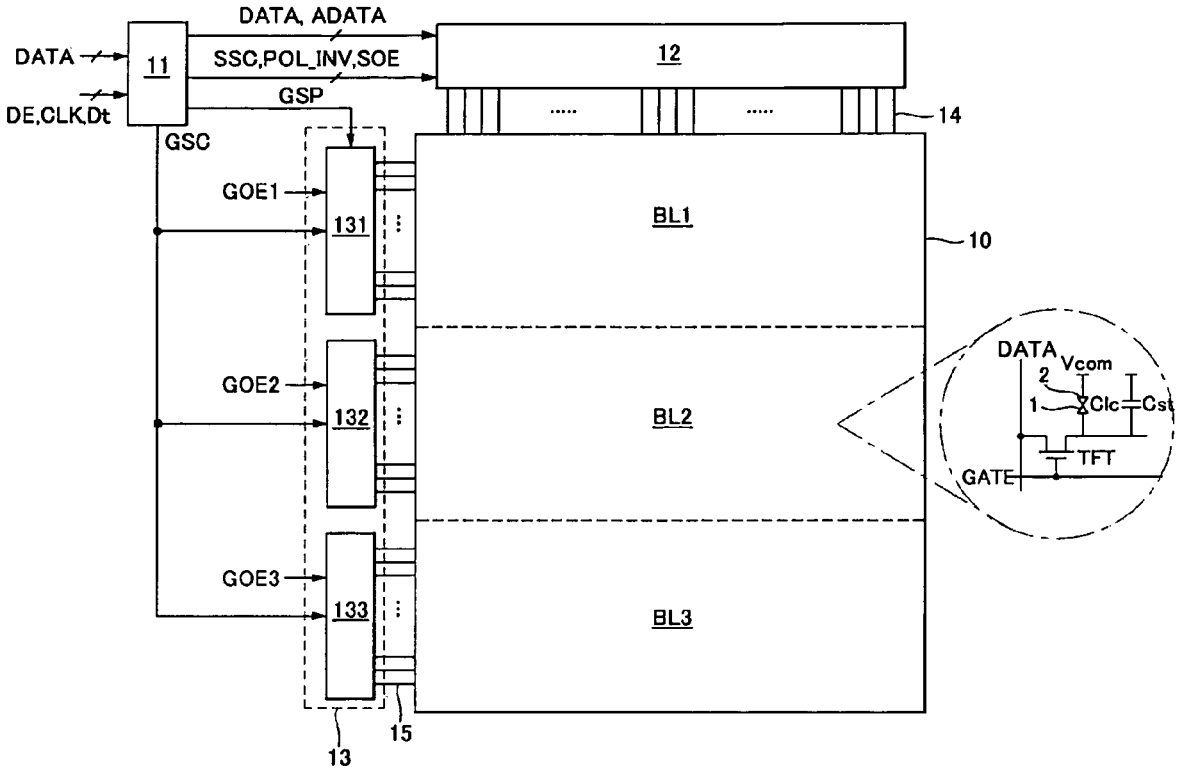
FIG. 1 is a block diagram of a liquid crystal display according to a first exemplary embodiment.

As shown in FIG. 1, a liquid crystal display according to a first exemplary embodiment includes a liquid crystal display panel 10, a timing controller 11, a data drive circuit 12, and a gate drive circuit 13. The data drive circuit 12 includes a plurality of data driver integrated circuits (IC) (not shown). The gate drive circuit 13 includes a plurality of gate driver ICs 131 to 133.

In the liquid crystal display panel 10, a liquid crystal layer is formed between two glass substrates. The liquid crystal display panel 10 includes m×n liquid crystal cells Clc arranged at each crossing of m data lines 14 and n gate lines 15 in a matrix format.

The data lines 14, the gate lines 15, thin film transistors (TFTs), and a storage capacitor Cst are formed on a lower glass substrate of the liquid crystal display panel 10. The liquid crystal cells Clc are connected to the TFTs and are driven by an electric field between pixel electrodes 1 and a common electrode 2. A black matrix, a color filter, and a common electrode 2 are formed on an upper glass substrate of the liquid crystal display panel 10. The common electrode 2 is formed on the upper glass substrate in a vertical electric drive manner, such as a twisted nematic (TN) mode and a vertical alignment (VA) mode. The common electrode 2 and the pixel electrode 1 are formed on the lower glass substrate in a horizontal electric drive manner, such as an in-plane switching (IPS) mode and a fringe field switching (FFS) mode. Polarizing plates are respectively attached to the upper and lower glass substrates of the liquid crystal display panel 10. Alignment layers for setting a pre-tilt angle of the liquid crystal are respectively formed on the upper and lower glass substrates.

A display screen of the liquid crystal display panel 10 is division-driven by dividing the display screen into a plurality of blocks BL1 to BL3 depending on gate timing control signals applied to the gate driver ICs 131 to 133. When the liquid crystal cells of each of the blocks BL1 to BL3 are driven at a frame frequency of 60 Hz, the liquid crystal cells of each of the blocks BL1 to BL3 are charged to a data voltage every 1 frame period. Further, when the liquid crystal cells of each of the blocks BL1 to BL3 are driven at a frame frequency of 75 to 120 Hz at predetermined time intervals, the liquid crystal cells of each of the blocks BL1 to BL3 are charged to an average voltage with a polarity opposite a polarity of the data voltage, to which the liquid crystal cells were charged during a previous frame period, during a frame period, and then are charged to the data voltage with a polarity opposite the polarity of the average voltage.

Figure 2:
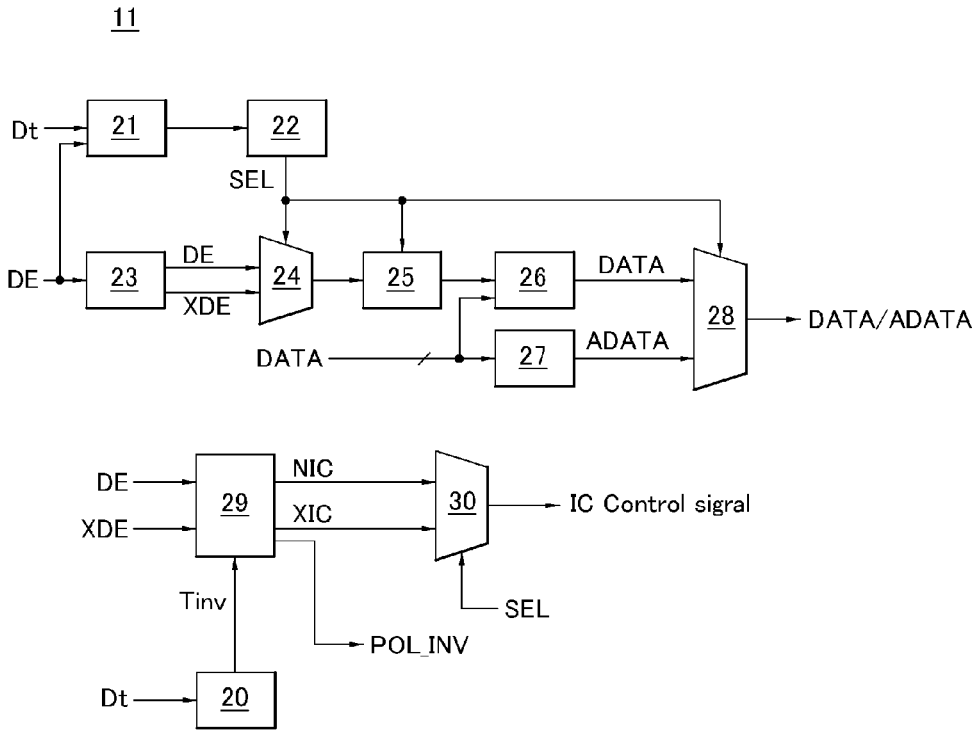
FIG. 2 is a block diagram showing in detail a timing controller shown in FIG. 1.

The timing controller 11 receives timing signals, such as a data enable signal DE and a dot clock CLK, and generates control signals for controlling operation timing of the data drive circuit 12 and operation timing of the gate drive circuit 13. The control signals are generated based on a frame frequency of 60 Hz for a predetermined period of time and are generated based on a frame frequency of 75 to 120 Hz at predetermined time intervals. The control signals include a data timing control signal and a gate timing control signal. The timing controller 11 multiplies a transmission frequency of digital video data DATA, that is received from an external system board at predetermined time intervals, in conformity with the 75 to 120 Hz frame frequency to transmit the multiplied digital video data DATA to the data drive circuit 12. A circuit configuration of the timing controller 11 is illustrated in FIG. 2.

Figure 9:
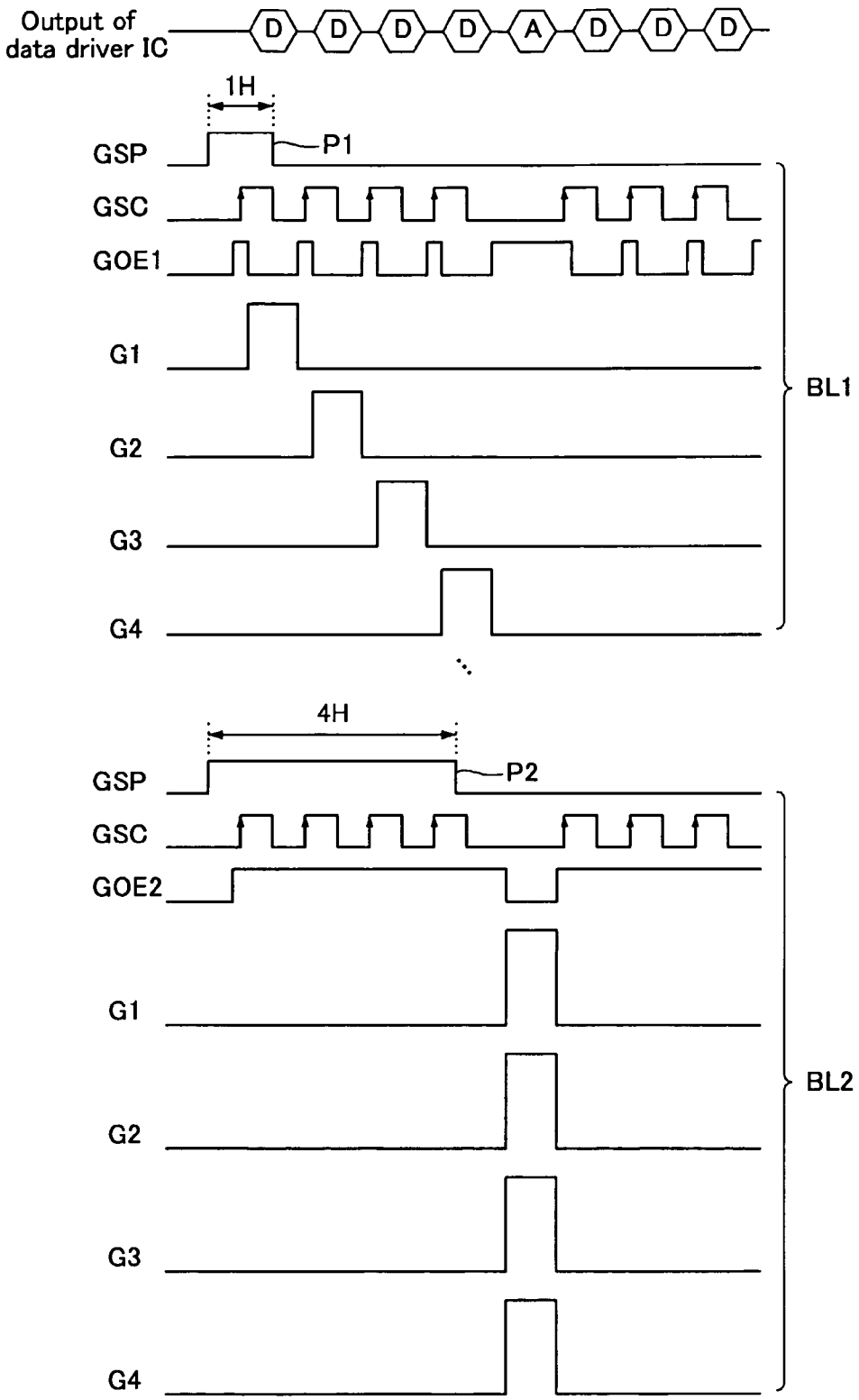

The gate timing control signal includes a gate start pulse GSP, a gate shift clock GSC, first to third gate output enable signals GOE1 to GOE3, and so on. The gate start pulse GSP is applied to only the first gate driver IC 131 to thereby indicate a scan start line of a scan operation so that the first gate driver IC 131 generates a first gate pulse. The second and third gate driver ICs 132 and 133 receive a carry signal generated by the first gate driver IC 131 as a gate start pulse to operate. The gate start pulse GSP controls the start of the scan operation. The gate start pulse GSP, as shown in FIG. 9, includes two pulses each having a different width during a 75 to 120 Hz frame period. More specifically, the gate start pulse GSP shown in FIG. 9 includes a first pulse P1 with a narrow width and a second pulse P2 with a wide width generated following the first pulse P1. The first pulse P1 directs a start of a scan operation to the block, that is charged to the average voltage having a polarity opposite a polarity of the data voltage of a previous frame period. In FIG. 9, as soon as frame 1 period starts, only the first pulse P1 of the gate start pulse GSP is generated during a 60 Hz frame period. The gate shift clock GSC is a clock signal for shifting the gate start pulse GSP. As shown in FIG. 9, during the 75 to 120 Hz frame period, a pulse of the gate shift clock GSC is generated every 1 horizontal period during 4 horizontal periods, and then is generated at a low logic level during a fifth horizontal period following the 4 horizontal periods. The pulse of the gate shift clock GSC is generated every 1 horizontal period during the 60 Hz frame period. The first to third gate output enable signals GOE1 to GOE3 are independently applied to the gate driver ICs 131 to 133. The gate driver ICs 131 to 133 output gate pulses during low logic periods of the gate output enable signals GOE1 to GOE3, i.e., during a period of time ranging from immediately after a falling time of a pulse to immediately before a rising time of a next pulse. The gate driver ICs 131 to 133 do not generate the gate pulse during high logic periods of the gate output enable signals GOE1 to GOE3. The first to third gate output enable signals GOE1 to GOE3 include a pulse with a high duty ratio applied to the gate driver IC scanning the block charged to the average voltage, that has a polarity opposite a polarity of the data voltage of a previous frame period, every 4 horizontal periods during the 75 to 120 Hz frame period, a pulse with a low duty ratio that is applied to the gate driver IC scanning the block charged to the data voltage every 1 horizontal period during the 60 Hz frame period. The first to third gate output enable signals GOE1 to GOE3 are supplied to all the gate driver ICs in-phase during the 60 Hz frame period.

The data timing control signal includes a source sampling clock SSC, an inverse polarity control signal POL_INV, a source output enable signal SOE, and so on. The source sampling clock SSC directs a data latch operation to the data drive circuit 12 based on a rising or falling edge. The inverse polarity control signal POL_INV controls a polarity of a video data voltage output by the data drive circuit 12. The source output enable signal SOE controls an output of the data drive circuit 12.

The timing controller 11 periodically inverts a polarity control signal in response to periodic data Dt to generate the inverse polarity control signal POL_INV. The periodic data Dt is input to the timing controller 11 through an external system board or a user interface or is stored in a register inside the timing controller 11.

Figure 4:
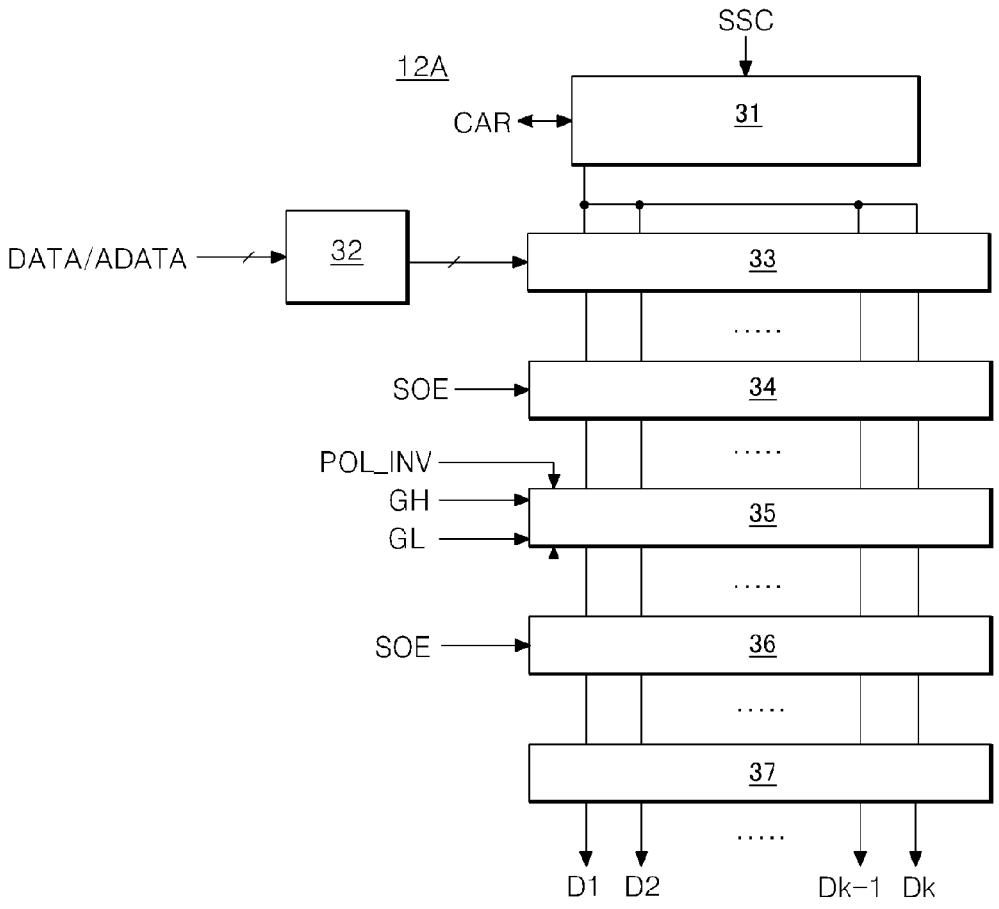
FIG. 4 is a block diagram showing in detail a data driver integrated circuit (IC) shown in FIG. 1.
Figure 5:
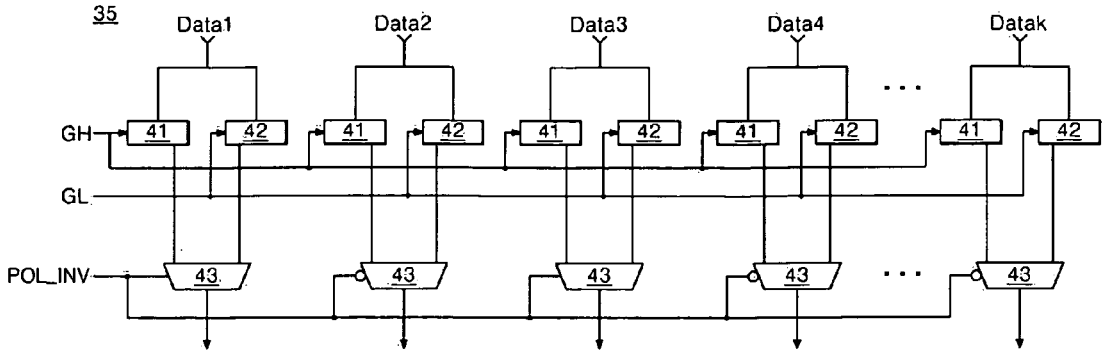
FIG. 5 is a circuit diagram showing in detail a digital-to-analog converter shown in FIG. 4.

The data drive circuit 12 latches the digital average data ADATA and the digital video data DATA under the control of the timing controller 11. The data drive circuit 12 converts the digital average data ADATA and the digital video data DATA into an analog positive or negative gamma compensation voltage in response to the inverse polarity control signal POL_INV to thereby generate a positive or negative average voltage and a positive or negative analog video data voltage. Then, the data drive circuit 12 supplies these voltages to the data lines 14. After the data drive circuit 12 outputs the positive/negative average voltage during 1 horizontal period, the data drive circuit 12 outputs the positive/negative analog video data voltage during 4 horizontal periods. These output operation is repeatedly performed. A circuit configuration of each of the data driver ICs of the data drive circuit 12 is illustrated in FIGS. 4 and 5.

Figure 6:
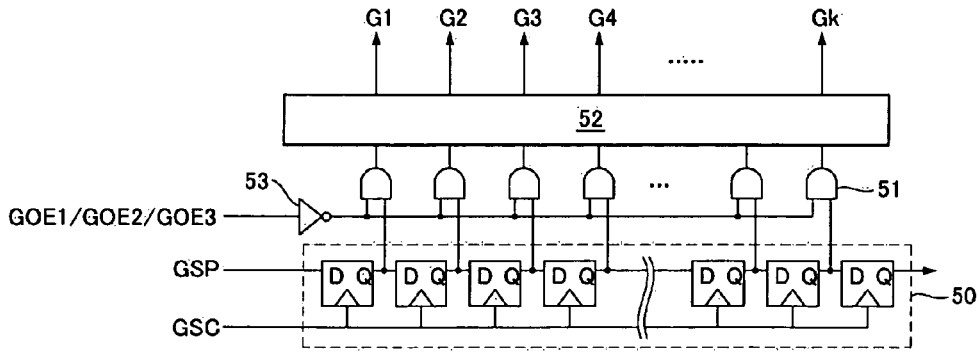
FIG. 6 is a circuit diagram showing in detail a gate driver IC shown in FIG. 1.

The gate drive circuit 13 sequentially supplies the gate pulses to the gate lines 15 under the control of the timing controller 11. A circuit configuration of each of the gate driver ICs of the gate drive circuit 13 is illustrated in FIG. 6.

The gate driver ICs 131 to 133 of the gate drive circuit 13 sequentially output the gate pulses during the 60 Hz frame period. During the 75 to 120 Hz frame period, the gate driver IC scanning the block charged to the data voltage to be displayed, sequentially applies the gate pulses to the 4 gate lines 15 during 4 horizontal periods, and then again outputs the gate pulses after 1 horizontal period. During the 75 to 120 Hz frame period, the gate driver IC scanning the block charged to the average voltage does not generate the gate pulse during the 4 horizontal periods, and then simultaneously applies the gate pulses to the 4 gate lines 15 during the 1 horizontal period.

FIG. 2 illustrates in detail the timing controller 11.

As shown in FIG. 2, the timing controller 11 includes a frame counter 21, a selection signal generating unit 22, a timing signal multiplying circuit 23, a first selector 24, a memory controller 25, a memory 26, an average data generating unit 27, a second selector 28, a timing control signal generating circuit 29, a polarity control signal control circuit 20, and a third selector 30.

The frame counter 21 counts pulses of the data enable signal DE, that are generated every 1 horizontal period. When a count value of the data enable signal DE is equal to the number of lines of the liquid crystal display panel 10, the frame counter 21 increases a count value of frame periods and counts the frame periods. The frame counter 21 compares a time point when a pulse of periodic data Dt is generated with a frame, and inverts an output during a frame period when the pulse of the periodic data Dt is generated.

The selection signal generating unit 22 generates a selection signal SEL in response to an output signal of the frame counter 21. The selection signal SEL has a first logic level indicating the 60 Hz frame period and a second logic level indicating the 75 to 120 Hz frame period.

The timing signal multiplying circuit 23 multiplies a frequency of the data enable signal DE based on the 60 Hz frame frequency and generates a multiplied data enable signal XDE based on the 75 to 120 Hz frame frequency.

The first selector 24 supplies the data enable signal DE based on the 60 Hz frame frequency to the memory controller 25 in response to the first logic level of the selection signal SEL. On the other hand, the first selector 24 supplies the multiplied data enable signal XDE based on the 75 to 120 Hz frame frequency to the memory controller 25 in response to the second logic level of the selection signal SEL.

The memory controller 25 generates a read address signal and a write address signal in conformity with the data enable signal DE based on the 60 Hz frame frequency in response to the first logic level of the selection signal SEL to control a memory 26 storing the digital video data DATA. The memory controller 25 generates a read address signal and a write address signal in conformity with the multiplied data enable signal XDE based on the 75 to 120 Hz frame frequency in response to the second logic level of the selection signal SEL, thereby allowing write and read operations of the memory 26 during the 75 to 120 Hz frame period to be performed more rapidly than write and read operations of the memory 26 during the 60 Hz frame period. The memory controller 25 and the memory 26 output the digital video data DATA using a high transmission frequency during a multiplied frame period, i.e., during the 75 to 120 Hz frame period, but output the digital video data DATA using a relatively low transmission frequency during a period except the multiplied frame period. The memory controller 25 and the memory 26 serve as a data processing circuit.

The average data generating unit 27 stores the memory 26 storing the digital video data DATA and calculates an average value of data input during a previous frame period or an average value of data input during a current frame period, thereby generating the digital average data ADATA. The average value may be an average value of 1 line or an average value of N lines, for example, 4 lines, where N is an integer equal to or larger than 2.

The second selector 28 outputs the digital video data DATA stored in the memory 26 during the 60 Hz frame period in response to the first logic level of the selection signal SEL to supply the digital video data DATA to the data drive circuit 12. On the other hand, during the 75 to 120 Hz frame period, the second selector 28 alternately outputs the digital video data DATA stored in the memory 26 and the digital average data ADATA generated by the average data generating unit 27 in response to the second logic level of the selection signal SEL to supply the digital video data DATA and the digital average data ADATA to the data drive circuit 12.

The timing control signal generating circuit 29 generates a gate or data timing control signal NIC for 60 Hz drive based on the data enable signal DE. The timing control signal generating circuit 29 generates a gate or data timing control signal XIC for 75 to 120 Hz drive based on the multiplied data enable signal XDE. The timing control signal generating circuit 29 once inverts the polarity control signal POL in response to an inverse periodic signal Tinv received from the polarity control signal control circuit 20 during the 75 to 120 Hz frame period to generate the inverse polarity control signal POL_INV. The polarity control signal POL is the substantially same as a polarity control signal for controlling a polarity of a data voltage that is input to a data drive circuit and is output from the data drive circuit in a related art.

The polarity control signal control circuit 20 generates the inverse periodic signal Tinv, whose a logic level is inverted at predetermined time intervals, in response to the periodic data Dt to supply the inverse periodic signal Tinv to the timing control signal generating circuit 29.

The third selector 30 outputs the gate/data timing control signal NIC for 60 Hz drive during the 60 Hz frame period in response to the first logic level of the selection signal SEL, and outputs the gate/data timing control signal XIC for 75 to 120 Hz during the 75 to 120 Hz frame period in response to the second logic level of the selection signal SEL. The operation timing of the data drive circuit 12 and the operation timing of the gate drive circuit 13 are controlled using the gate/data timing control signals NIC and XIC output by the third selector 30. Accordingly, operation frequencies of the data drive circuit 12 and the gate drive circuit 13 during the 75 to 120 Hz frame period are larger than the operation frequencies of those during the 60 Hz frame period.

Figure 3:
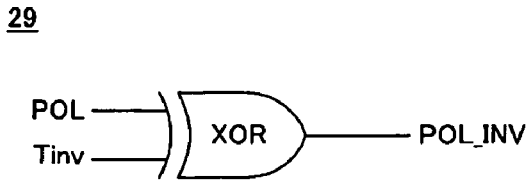
FIG. 3 is a circuit diagram illustrating a timing control signal generating circuit shown in FIG. 2.

FIG. 3 illustrates the timing control signal generating circuit 29.

As shown in FIG. 3, the timing control signal generating circuit 29 includes an exclusive OR (symbolized XOR or EOR) gate XOR.

The XOR gate XOR inverts the polarity control signal POL in response to the inverse polarity control signal Tinv input by the polarity control signal control circuit 20 to generate the inverse polarity control signal POL_INV whose a logic level is once inverted during the 75 to 120 Hz frame period. A phase of the inverse polarity control signal POL_INV is inverted every 1 frame period during the 60 Hz frame period. However, during the 75 to 120 Hz frame period, the phase of the inverse polarity control signal POL_INV is inverted as soon as 1 frame period starts, and is again inverted before the 1 frame period ends. Accordingly, all the liquid crystal cells of the liquid crystal display panel 10 are charged to the data voltage of a predetermined polarity during the 60 Hz frame period. On the other hand, during the 75 to 120 Hz frame period, all the liquid crystal cells of the liquid crystal display panel 10 are charged to the average voltage with a polarity opposite a polarity of the data voltage of a previous frame period, and then are charged to the data voltage with a polarity opposite the polarity of the average voltage.

Because a frequency of the inverse polarity control signal POL_INV increases during a multiplied frame period, i.e., during the 75 to 120 Hz frame period, a frequency of the data voltage, to which the liquid crystal cells are charged during the multiplied frame period, increases.

FIGS. 4 and 5 illustrate a data driver IC 12A.

As shown in FIGS. 4 and 5, each data driver IC 12A includes a shift register 31, a data register 32, a first latch array 33, a second latch array 34, a digital-to-analog converter (DAC) 35, a charge share circuit 36, and an output circuit 37.

The data register 32 temporarily stores the digital video data DATA and the digital average data ADATA received from the timing controller 11.

The shift register 31 shifts a sampling signal in response to the source sampling clock signal SSC. When data more than the number of latches of the first latch array 33 is supplied, the shift register 31 generates a carry signal CAR.

The first latch array 33 samples and latches the digital video data DATA and the digital average data ADATA received from the data register 32 in response to the sampling signals sequentially received from the shift register 31. Then, the first latch array 33 simultaneously outputs the digital video data DATA and the digital average data ADATA.

The second latch array 34 latches the data received from the first latch array 33. Then, the second latch array 34 of one data driver ICs 12A and the second latch arrays 34 of the other data driver ICs 12A simultaneously output the latched data during a low logic period of the source output enable signal SOE.

The DAC 35, as shown in FIG. 5, includes a P-decoder 41 to which a positive gamma compensation voltage GH is supplied, a N-decoder 42 to which a negative gamma compensation voltage GL is supplied, and a multiplexer 43 selecting an output of the P-decoder 41 and an output of the N-decoder 41 in response to the inverse polarity control signal POL_INV. The P-decoder 41 decodes the data received from the second latch array 34 to output the positive gamma compensation voltage GH corresponding to gray values of the data. The N-decoder 42 decodes the data received from the second latch array 34 to output the negative gamma compensation voltage GL corresponding to gray values of the data. The multiplexer 43 selects the positive gamma compensation voltage GH and the negative gamma compensation voltage GL in response to the inverse polarity control signal POL_INV.

The charge share circuit 36 shorts neighboring data output channels during a high logic period of the source output enable signal SOE to output an average value of neighboring data voltages as a charge share voltage. Or, the charge share circuit 36 supplies a common voltage Vcom to the data output channels during the high logic period of the source output enable signal SOE to reduce sharp changes in a positive voltage and a negative voltage to be supplied to the data lines 14.

The output circuit 37 includes a buffer to thereby reduce the signal attenuation of a voltage supplied to the data lines D1 to Dk.

FIG. 6 illustrates the gate driver ICs 131 to 133.

As shown in FIG. 6, each of the gate driver ICs 131 to 133 includes a shift register 50, a level shifter 52, a plurality of AND gates 51 connected between the shift register 50 and the level shifter 52, and an inverter 53 for inverting the gate output enable signals GOE1 to GOE3.

The shift register 50 sequentially shifts the gate start pulse GSP depending on the gate shift clock GSC using a plurality of cascade connected D flip-flops. Each of the AND gates 51 performs an AND operation on an output signal of the shift register 50 and inverse signals of the gate output enable signals GOE1 to GOE3 to produce a logic output. The inverter 53 inverts the gate output enable signals GOE1 to GOE3 to supply the inverse signals of the gate output enable signals GOE1 to GOE3 to the AND gates 51. Accordingly, the gate driver ICs 131 to 133 produce outputs only when the gate output enable signals GOE1 to GOE3 are in a low logic period.

The level shifter 52 shifts a swing width of an output voltage of the AND gates 51 within the range of an operation voltage of a TFT inside a pixel array of the liquid crystal display panel 10. Output signals G1 to Gk of the level shifter 52 are sequentially supplied to the k gate lines 15, where k is an integer. The level shifter 52 is positioned in front of the shift register 50. The shift register 50 and the TFT of the pixel array may be directly positioned on the glass substrate of the liquid crystal display panel 10.

Figure 7:
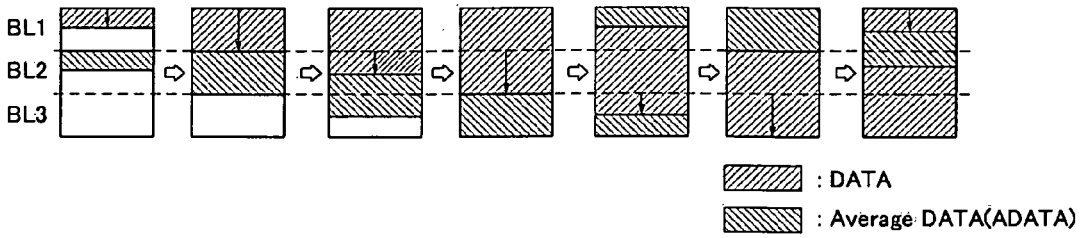
FIGS. 7 to 9 are diagrams illustrating an exemplary operation of the liquid crystal display according to the first exemplary embodiment.
Figure 8:
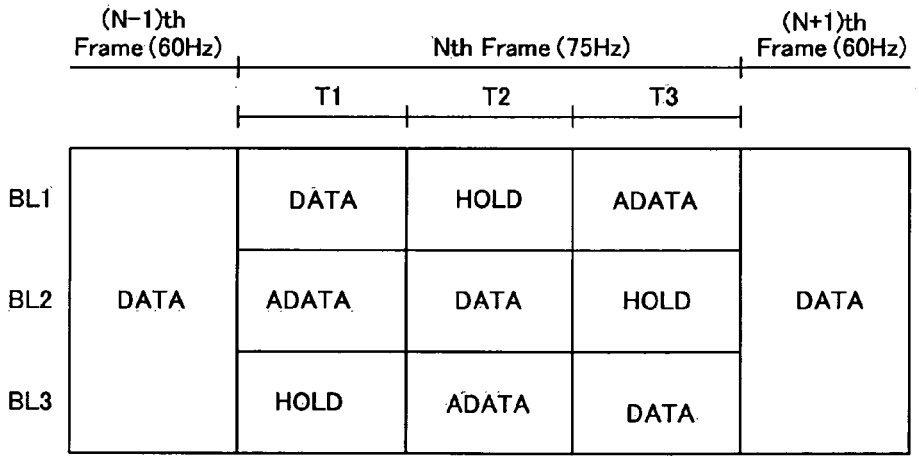

FIGS. 7 to 9 are diagrams illustrating an exemplary operation of the liquid crystal display according to the first exemplary embodiment. In FIGS. 7 to 9, all the liquid crystal cells are driven at a frame frequency of 60 Hz, and are periodically driven at a frame frequency of 75 Hz.

As shown in FIGS. 7 to 9, the liquid crystal display according to the first exemplary embodiment controls the data drive circuit 12 and the gate drive circuit 13 using the frame frequency of 60 Hz during the 60 Hz frame period to sequentially apply the gate pulses synchronized with the data voltage DATA to be displayed to the first to last gate lines. During the 60 Hz frame period, each of all the liquid crystal cells is once charged to the data voltage DATA. During the 60 Hz frame period, a polarity of the data voltage DATA to which all the liquid crystal cells are charged during a frame period is opposite to a polarity of the data voltage DATA to which all the liquid crystal cells are charged during a previous frame period. Further, the liquid crystal display according to the first exemplary embodiment increases operation frequencies of the data drive circuit 12 and the gate drive circuit 13 in response to the periodic data Dt received from the outside during the 75 Hz frame period. As soon as the 75 Hz frame period starts, the liquid crystal cells are charged to the average voltage ADATA with a polarity opposite a polarity of the data voltage DATA of a previous frame period. Then, the liquid crystal cells are charged to the data voltage DATA with a polarity opposite the polarity of the average voltage ADATA after the passage of about ⅓ to ⅔ of the 75 Hz frame period from a start of the 75 Hz frame period.

FIG. 9 is a waveform diagram illustrating changes in the gate timing control signal and changes in the data voltage during the 75 Hz frame period.

As shown in FIGS. 8 and 9, during a period T1, the first gate driver IC 131 starts to operate in response to the first pulse P1 of the gate start pulse GSP generated as soon as the period T1 starts. In the gate shift clock GSC, after a pulse is generated every 1 horizontal period during 4 horizontal periods, the pulse is again generated after 2 horizontal periods. In the first gate output enable signal GOE1, after a pulse is generated every 1 horizontal period during 4 horizontal periods, the pulse is hold at a high logic level during 1 horizontal period. Then, the pulse is again generated every 1 horizontal period. As a result, after the first gate driver IC 131 sequentially supplies the gate pulses to the 4 gate lines during 4 horizontal periods, the first gate driver IC 131 stops an output during 1 horizontal period. Then, the first gate driver IC 131 repeats an operation to sequentially supply the gate pulses to the gate lines. The liquid crystal cells of each line of the first block BL1 scanned by the first gate driver IC 131 are sequentially charged to the positive/negative analog video data voltage DATA received from the data drive circuit 12 during the period T1. As soon as the period T1 starts, the second gate driver IC 132 receives the carry signal from the first gate driver IC 131. The gate shift clock GSC applied to the second gate driver IC 132 is the same as the gate shift clock GSC applied to the first gate driver IC 131. In the second gate output enable signal GOE2 applied to the second gate driver IC 132, after a pulse is hold at a high logic level during the 4 horizontal periods when 4 lines are charged to the positive/negative analog video data voltage DATA in the first block BL1, the pulse is inverted to a low logic level during 1 horizontal period. Then, a pulse having a width corresponding to a length of 4 horizontal periods is again generated. As a result, in the second gate driver IC 132, a carry signal having a width corresponding to a length of 4 or more horizontal periods is shifted at a time interval of 1 horizontal period, and thus the carry signals overlap each other. An overlap pulse width of the carry signals corresponds to a length of 3 or more horizontal periods. The gate pulses received from the second gate driver IC 132 are simultaneously supplied to the 4 gate lines because of the overlap of the carry signals during horizontal periods corresponding to a multiple of 5 when the second gate output enable signal GOE2 is hold at a low logic level. Accordingly, the liquid crystal cells of the second block BL2 scanned by the second gate driver IC 132 are simultaneously charged to the positive/negative average voltage ADATA received from the data drive circuit 12 every 4 lines during the period T1. A polarity of the average voltage ADATA of the liquid crystal cells of the second block BL2 is opposite to a polarity of the data voltage DATA, to which the liquid crystal cells were charged during a previous frame period. The third gate driver IC 133 does not receive the carry signal from the second gate driver IC 132 during the period T1. Therefore, the third block BL3 is hold at the video data voltage DATA to which the liquid crystal cells of the third block BL3 were charged during a period T3 of a previous frame.

During a period T2, the first gate driver IC 131 does not receive the gate start pulse GSP from the timing controller 11. Hence, because the first gate driver IC 131 does not generate the gate pulse during the period T2, the first block BL1 is hold at the data voltage DATA to which the liquid crystal cells of the first block BL1 were charged during the period T1. As soon as the period T2 starts, the second gate driver IC 132 receives the first pulse P1 of the gate start pulse GSP from the first gate driver IC 131 as the carry signal. Accordingly, after the second gate driver IC 132 sequentially supplies the gate pulses to the 4 gate lines during 4 horizontal periods, the second gate driver IC 132 stops an output during 1 horizontal period. Then, the second gate driver IC 132 repeats an operation to sequentially supply the gate pulses to the gate lines. The liquid crystal cells of each line of the second block BL2 scanned by the second gate driver IC 132 are sequentially charged to the positive/negative analog video data voltage DATA received from the data drive circuit 12 during the period T2. A polarity of the data voltage DATA of the liquid crystal cells of the second block BL2 during the period T2 is opposite to a polarity of the average voltage ADATA, to which the liquid crystal cells of the second block BL2 were charged during the period T1. As soon as the period T2 starts, the third gate driver IC 133 receives the second pulse P2 of the gate start pulse GSP from the second gate driver IC 132 as the carry signal. As a result, after the third gate driver IC 133 simultaneously supplies the gate pulses to the 4 gate lines, the third gate driver IC 133 repeats an operation to simultaneously supply the gate pulses to another 4 gate lines after 4 horizontal periods. Accordingly, the liquid crystal cells of the third block BL3 scanned by the third gate driver IC 133 are simultaneously charged to the average voltage ADATA received from the data drive circuit 12 every 4 lines during the period T2. A polarity of the average voltage ADATA of the liquid crystal cells of the third block BL3 during the period T2 is opposite to a polarity of the data voltage DATA, at which the liquid crystal cells of the third block BL3 were hold during the period T1.

As soon as a period T3 starts, the first gate driver IC 131 receives the second pulse P2 of the gate start pulse GSP from the timing controller 11. As a result, after the first gate driver IC 131 simultaneously supplies the gate pulses to the 4 gate lines during the period T3, the first gate driver IC 131 repeats an operation to simultaneously supply the gate pulses to another 4 gate lines after 4 horizontal periods. Accordingly, the liquid crystal cells of the first block BL1 scanned by the first gate driver IC 131 are simultaneously charged to the positive/negative average voltage ADATA received from the data drive circuit 12 every 4 lines during the period T3. A polarity of the average voltage ADATA of the liquid crystal cells of the first block BL1 during the period T3 is opposite to a polarity of the data voltage DATA, at which the liquid crystal cells of the first block BL1 were hold during the period T2. The second gate driver IC 132 does not receive the carry signal from the first gate driver IC 131 during the period T3. Hence, because the second gate driver IC 132 does not generate the gate pulse during the period T3, the second block BL2 is hold at the data voltage DATA to which the liquid crystal cells of the second block BL2 were charged during the period T2. As soon as the period T3 starts, the third gate driver IC 133 receives the first pulse P1 of the gate start pulse GSP from the first gate driver IC 131 as the carry signal. Accordingly, after the third gate driver IC 133 sequentially supplies the gate pulses to the 4 gate lines during the period T3, the third gate driver IC 133 stops an output during 1 horizontal period. Then, the third gate driver IC 133 repeats an operation to sequentially supply the gate pulses to the gate lines. The liquid crystal cells of the third block BL3 scanned by the third gate driver IC 133 are sequentially charged to the positive/negative analog video data voltage DATA received from the data drive circuit 12 in each line during the period T3. A polarity of the data voltage DATA of the liquid crystal cells of the third block BL3 during the period T3 is opposite to a polarity of the average voltage ADATA, at which the liquid crystal cells of the third block BL3 were hold during the period T2.

In FIG. 9, G1 to G4 indicate the gate pulses, and 1H indicates 1 horizontal period. A length of the 1 horizontal period is shorter than a length of 1 horizontal period of the data enable signal DE input to the timing controller 11 by the frequency multiplier.

Figure 10:
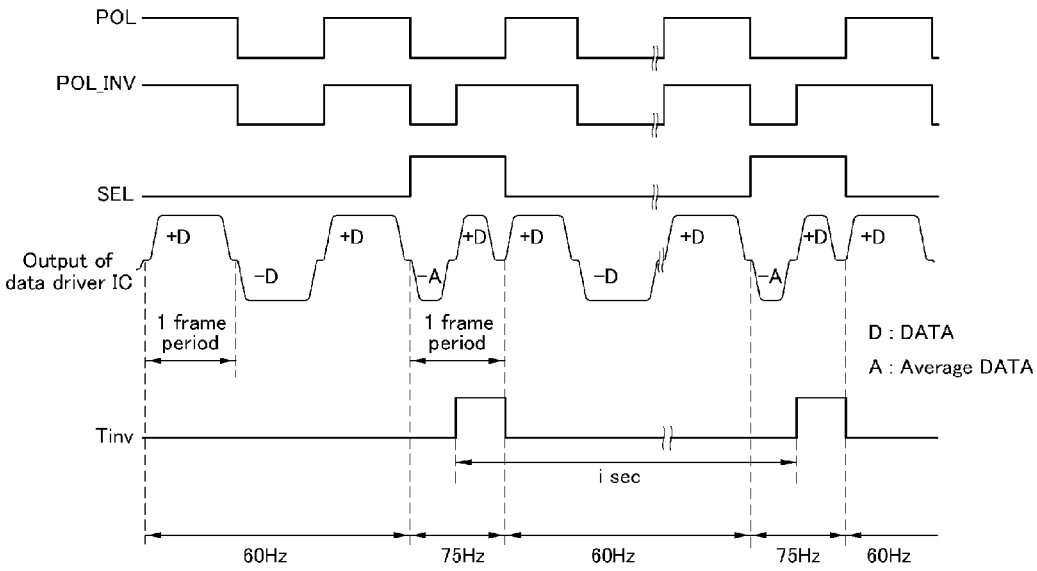
FIGS. 10 and 11 are diagrams showing waveforms of a polarity control signal, a selection signal, an inverse polarity control signal, and an inverse periodic signal and positive and negative analog video data voltages and positive and negative average voltages applied to the liquid crystal display according to the first exemplary embodiment.
Figure 11:
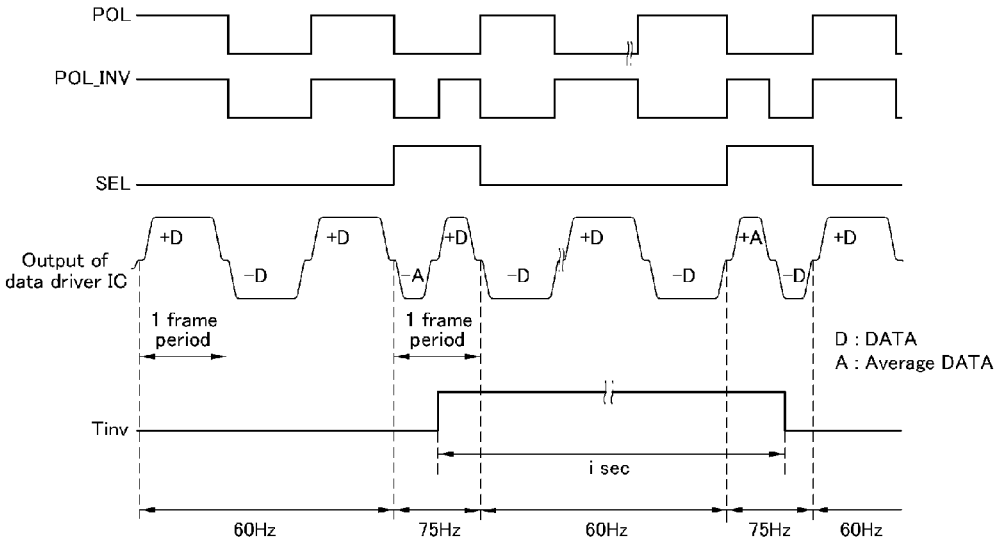

FIGS. 10 and 11 illustrate waveforms of the polarity control signal POL, the selection signal SEL, the inverse polarity control signal POL_INV, and the inverse periodic signal Tinv and positive and negative analog video data voltages +D and −D and positive and negative average voltages +A and −B controlled by the inverse polarity control signal POL_INV in the liquid crystal display according to the first exemplary embodiment. In FIGS. 10 and 11, the positive and negative analog video data voltages +D and −D and the positive and negative average voltages +A and −A are voltages to which the same liquid crystal cell is charged.

As shown in FIG. 10, the inverse periodic signal Tinv includes pulses generated every "i" sec, where "i" is an integer equal to or larger than 2. Each of the pulses of the inverse periodic signal Tinv is synchronized with the data voltage DATA to be displayed during a 75 Hz frame period. The polarity control signal POL is generated in the substantially same form as a related art polarity control signal. The polarity control signal POL allows the data voltages DATA, to which the liquid crystal cells will be charged during 1 frame period, to have the same polarity. A phase of the polarity control signal POL is inverted every frame period.

When the pulses of the inverse periodic signal Tinv are input, the timing controller 11 multiplies a frequency of the timing signal so as to drive the liquid crystal cells of the liquid crystal display panel 10 at a frame frequency of 75 Hz, thereby driving the data drive circuit 12 and the gate drive circuit 13 at the frame frequency of 75 Hz. At the same time, the timing controller 11 inverts the inverse polarity control signal POL_INV as soon as the 75 Hz frame period starts, and then again inverts the inverse polarity control signal POL_INV during the 75 Hz frame period.

The liquid crystal cells are charged to the data voltages DATA of the same polarity during the 60 Hz frame period. During the 75 Hz frame period, as soon as the 75 Hz frame period starts, the liquid crystal cells are charged to the average voltage ADATA of previous frame data or current frame data having a polarity opposite a polarity of the data voltage DATA, to which the liquid crystal cells were charged during a previous frame period. Then, the liquid crystal cells are charged to the data voltage DATA with a polarity opposite the polarity of the average voltage ADATA after the passage of about ⅓ to ⅔ of the 75 Hz frame period from a start of the 75 Hz frame period. Every time the pulse of the inverse periodic signal Tinv is input, the XOR gate XOR inverts the polarity control signal POL to generate the inverse polarity control signal POL_INV. Accordingly, while the liquid crystal molecules and the ions of the liquid crystal cells repeatedly move in the opposite direction during the 75 Hz frame periods when the pulses of the inverse periodic signal Tinv are input, the liquid crystal molecules and the ions of the liquid crystal cells are not polarized.

As shown in FIG. 11, the inverse periodic signal Tinv includes pulses that are generated every 2i sec and have a width of "i" sec. In the inverse periodic signal Tinv, a rising edge of the pulse is synchronized with to the data voltage DATA which the liquid crystal cells will be charged sequential to the average voltage ADATA during a 75 Hz frame period, and a falling edge of the pulse is synchronized with the data voltage DATA of another 75 Hz frame period after the passage of "i" sec from the rising edge. The polarity control signal POL is generated in the substantially same form as the related art polarity control signal. The polarity control signal POL allows the data voltages DATA, to which the liquid crystal cells will be charged during 1 frame period, to have the same polarity. A phase of the polarity control signal POL is inverted every frame period.

The liquid crystal cells are charged to the data voltages DATA with the same polarity in each frame period for 1 sec including the plurality of 60 Hz frame periods. During each of the 75 Hz frame periods that are defined by the inverse periodic signal Tinv and are arranged between the 60 Hz frame periods to be spaced apart from each other, the liquid crystal cells are charged to the average voltage ADATA with a polarity opposite a polarity of the data voltage DATA of a previous frame period, and then are charged to the data voltage DATA with a polarity opposite the polarity of the average voltage ADATA. In particular, a polarity of the average voltage and a polarity of the data voltage to which the liquid crystal cells are charged during a (M+1)-th 75 Hz frame period are respectively opposite to a polarity of the average voltage and a polarity of the data voltage to which the liquid crystal cells were charged during an M-th 75 Hz frame period prior to the (M+1)-th 75 Hz frame period, where M is a positive integer.

Accordingly, while the liquid crystal molecules and the ions of the liquid crystal cells repeatedly move in the opposite direction during the 75 Hz frame periods when the pulses of the inverse periodic signal Tinv are input, the liquid crystal molecules and the ions of the liquid crystal cells are not polarized.

As a result, in the liquid crystal display and the method of driving the same according to the first exemplary embodiment, because the liquid crystal cells are AC-driven during the 75 to 120 Hz frame period and the ions in the liquid crystal layer move two times in the opposite direction, the DC drive of the liquid crystal cells can be suppressed. Further, the appearance of stains on the display screen can be prevented by suppressing the polarization and accumulation of the ions.

Figure 12:
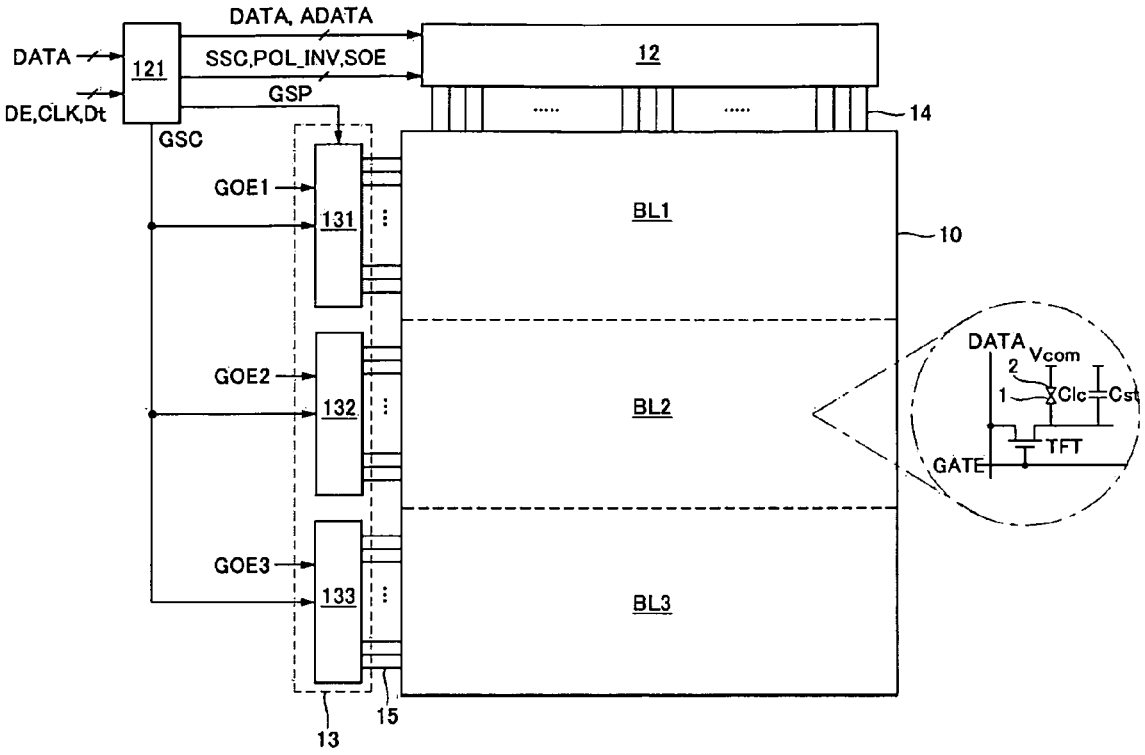
FIG. 12 is a block diagram of a liquid crystal display according to a second exemplary embodiment.

FIG. 12 is a block diagram of a liquid crystal display according to a second exemplary embodiment.

As show in FIG. 12, the liquid crystal display according to the second exemplary embodiment includes a liquid crystal display panel 10, a timing controller 121, a data drive circuit 12, and a gate drive circuit 13. Since structures of the liquid crystal display panel 10, the data drive circuit 12, and the gate drive circuit 13 are substantially the same as those described in the first exemplary embodiment, the description thereabout is briefly made or is entirely omitted.

Figure 13:
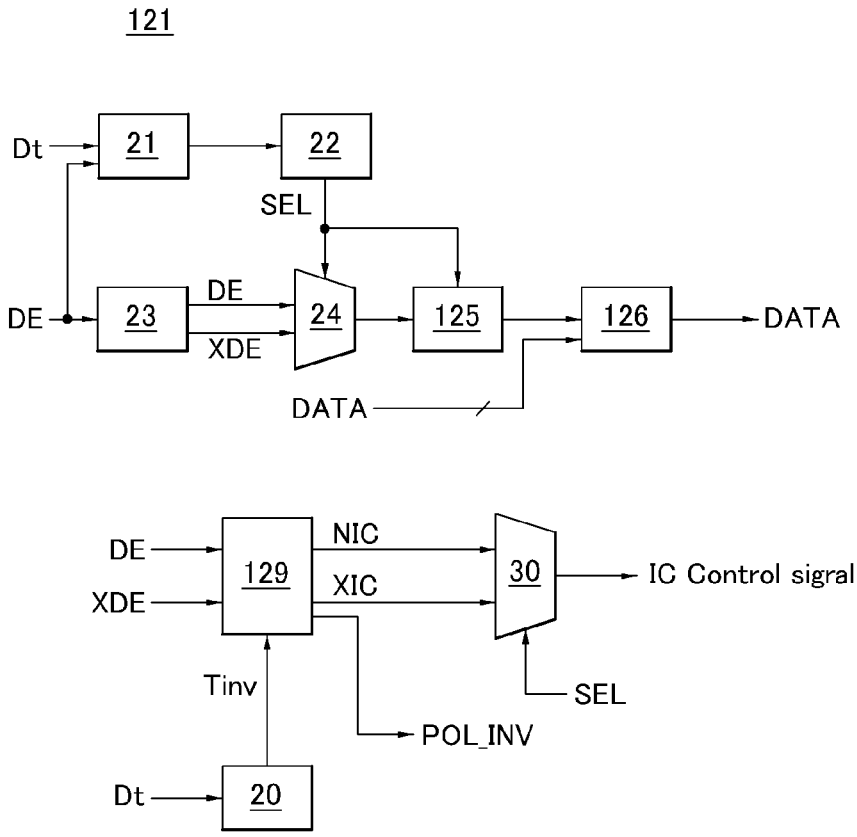
FIG. 13 is a block diagram showing in detail a timing controller shown in FIG. 12.

The timing controller 121 receives timing signals, such as a data enable signal DE and a dot clock CLK, and generates control signals for controlling operation timing of the data drive circuit 12 and operation timing of the gate drive circuit 13. The control signals are generated based on a frame frequency of 60 Hz for a predetermined period of time and are generated based on a frame frequency of 80 to 120 Hz at predetermined time intervals. The control signals include a data timing control signal and a gate timing control signal. The timing controller 121 multiplies a transmission frequency of digital video data DATA, that is received from an external system board at predetermined time intervals, in conformity with the 80 to 120 Hz frame frequency to transmit the multiplied digital video data DATA to the data drive circuit 12. A circuit configuration of the timing controller 121 is illustrated in FIG. 13.

The timing controller 121 generates the gate timing control signal including a gate start pulse GSP, a gate shift clock GSC, first to third gate output enable signals GOE1 to GOE3, and so on, during a 60 Hz frame period so that the gate timing control signal is suitable to sequentially drive the entire screen. The timing controller 121 modulates the data timing control signal and the gate timing control signal during an 80 to 120 Hz frame period.

The timing controller 121 periodically inverts a polarity control signal in response to periodic data Dt to generate an inverse polarity control signal POL_INV. The periodic data Dt is input to the timing controller 121 through an external system board or a user interface or is stored in a register inside the timing controller 121.

The data drive circuit 12 has the circuit configuration shown in FIGS. 4 and 5. During the 80 to 120 Hz frame period, the data drive circuit 12 outputs a data voltage with a polarity opposite a polarity of the data voltage, to which liquid crystal cells of the liquid crystal display panel 10 are charged during a previous frame period, in response to the modulated data timing control signal, and then outputs the data voltage with the same polarity as the polarity of the data voltage of the previous frame period. The data drive circuit 12 repeatedly performs the above output operation during the 80 to 120 Hz frame period. During the 60 Hz frame period, the data drive circuit 12 outputs the data voltage with the polarity opposite the polarity of the data voltage, to which the liquid crystal cells are charged during a previous frame period.

Each of gate driver ICs 131 to 133 of the gate drive circuit 13 has the circuit configuration shown in FIG. 6. The gate driver ICs 131 to 133 of the gate drive circuit 13 sequentially output the gate pulses during the 60 Hz frame period. During the 80 to 120 Hz frame period, the gate driver ICs 131 to 133 of the gate drive circuit 13 sequentially supply gate pulses to gate lines of one block in response to the modulated gate timing control signal so that the liquid crystal cells of the one block are charged to the data voltage with a polarity opposite a polarity of the data voltage of a previous frame period. Then, the gate driver ICs 131 to 133 sequentially supply gate pulses to gate lines of another block so that the liquid crystal cells of another block are charged to the data voltage with the same polarity as the polarity of the data voltage of the previous frame period.

FIG. 13 illustrates in detail the timing controller 121.

As shown in FIG. 13, the timing controller 121 includes a frame counter 21, a selection signal generating unit 22, a timing signal multiplying circuit 23, a first selector 24, a memory controller 125, a memory 126, a timing control signal generating circuit 129, a polarity control signal control circuit 20, and a third selector 30. Since structures of the frame counter 21, the selection signal generating unit 22, the timing signal multiplying circuit 23, the first selector 24, the polarity control signal control circuit 20, and the third selector 30 are substantially the same as those described in the first exemplary embodiment, the description thereabout is briefly made or is entirely omitted.

The memory controller 125 generates a read address signal and a write address signal in conformity with the data enable signal DE based on the 60 Hz frame frequency in response to a first logic level of the selection signal SEL to control a memory 26 storing digital video data. The memory controller 125 generates a read address signal and a write address signal in conformity with an input frequency of the multiplied data enable signal DE in response to a second logic level of the selection signal SEL, thereby allowing write and read operations of the memory 126 during the 80 to 120 Hz frame period to be performed more rapidly than write and read operations of the memory 126 during the 60 Hz frame period.

During the 60 Hz frame period, the memory 126 outputs digital video data DATA to be displayed during a current frame period under the control of the memory controller 125. During the 80 to 120 Hz frame period, the memory 126 outputs digital video data, to which the liquid crystal cells were charged during a previous frame period, under the control of the memory controller 125, and then outputs digital video data of a current frame period or successively outputs two times the digital video data of the current frame period.

The timing control signal generating circuit 129 generates a gate or data timing control signal NIC for 60 Hz drive based on the data enable signal DE. The timing control signal generating circuit 129 generates a gate or data timing control signal XIC for 80 to 120 Hz drive based on multiplied data enable signal XDE. The timing control signal generating circuit 129 once inverts the polarity control signal POL in response to an inverse periodic signal Tinv using the circuit shown in FIG. 3 during the 80 to 120 Hz frame period to generate the inverse polarity control signal POL_INV. The polarity control signal POL is the substantially same as a polarity control signal for controlling a polarity of a data voltage that is input to a data drive circuit and is output from the data drive circuit in a related art.

Figure 14:
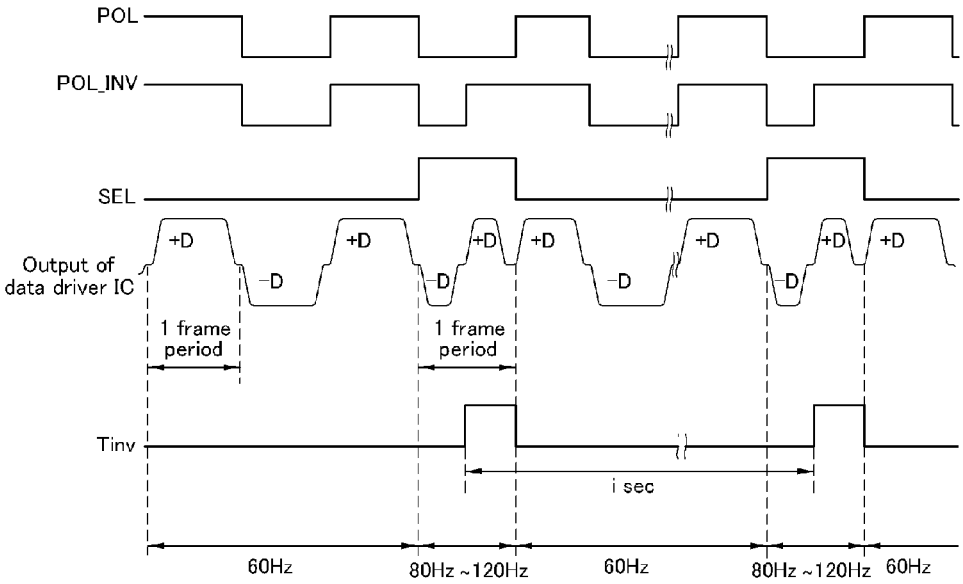
FIGS. 14 and 15 are diagrams showing waveforms of a polarity control signal, a selection signal, an inverse polarity control signal, and an inverse periodic signal and positive and negative analog video data voltages applied to the liquid crystal display according to the second exemplary embodiment.
Figure 15:
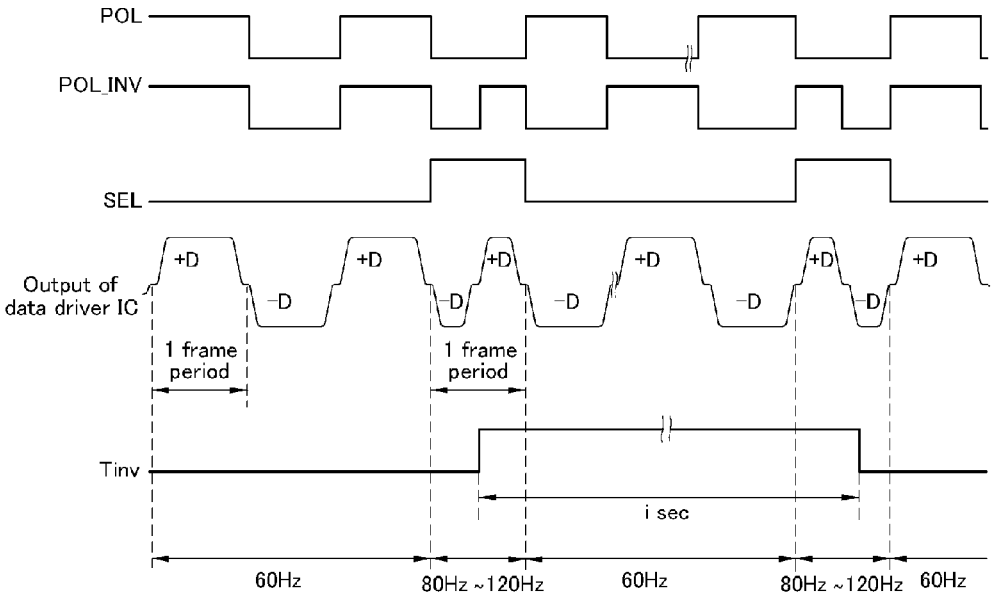

FIGS. 14 and 15 illustrate waveforms of the polarity control signal POL, the selection signal SEL, the inverse polarity control signal POL_INV, and the inverse periodic signal Tinv and positive and negative analog video data voltages +D and −D controlled by the inverse polarity control signal POL_INV in the liquid crystal display according to the second exemplary embodiment. In FIGS. 14 and 15, the positive and negative analog video data voltages +D and −D are voltages to which the same liquid crystal cell is charged.

As shown in FIG. 14, the inverse periodic signal Tinv includes pulses generated every "i" sec, where "i" is an integer equal to or larger than 2. Each of the pulses of the inverse periodic signal Tinv is synchronized with data voltage DATA to be currently displayed during an 80 to 120 Hz frame period. The polarity control signal POL is generated in the substantially same form as a related art polarity control signal.

When the pulses of the inverse periodic signal Tinv are input, the timing controller 121 multiplies a frequency of the timing signal so as to drive the liquid crystal cells of the liquid crystal display panel 10 at a frame frequency of 80 to 120 Hz, thereby driving the data drive circuit 12 and the gate drive circuit 13 at the frame frequency of 80 to 120 Hz. At the same time, the timing controller 121 inverts the inverse polarity control signal POL_INV as soon as the 80 to 120 Hz frame period starts, and then again inverts the inverse polarity control signal POL_INV during the 80 to 120 Hz frame period.

The liquid crystal cells are charge to the data voltages DATA of the same polarity during the 60 Hz frame period. During the 80 to 120 Hz frame period, as soon as the 80 to 120 Hz frame period starts, the liquid crystal cells are charged to the data voltage DATA of a previous frame period or a current frame period having a polarity opposite a polarity of the data voltage DATA of the previous frame period. After the passage of about ⅓ to ⅔ of the 80 to 120 Hz frame period from a start of the 80 to 120 Hz frame period, the liquid crystal cells are charged to the data voltage DATA whose a polarity is the same as the polarity of the data voltage DATA of the previous frame period and is opposite to the polarity the data voltage DATA charged as soon as the 80 to 120 Hz frame period starts. Every time the pulse of the inverse periodic signal Tinv is input, an XOR gate XOR inverts the polarity control signal POL to generate the inverse polarity control signal POL_INV. Accordingly, while the liquid crystal molecules and the ions of the liquid crystal cells repeatedly move in the opposite direction during the 80 to 120 Hz frame periods when the pulses of the inverse periodic signal Tinv are input, the liquid crystal molecules and the ions of the liquid crystal cells are not polarized.

As shown in FIG. 15, the inverse periodic signal Tinv includes pulses that are generated every 2i sec and have a width of "i" sec. During a 80 to 120 Hz frame period, a rising edge of the pulse of the inverse periodic signal Tinv is synchronized with the data voltage DATA, that is generated sequential to the data voltage DATA with a polarity opposite a polarity of the data voltage DATA of a previous frame and has the same polarity as the polarity of the data voltage DATA of the previous frame. A falling edge of the pulse is synchronized with the data voltage DATA of another 80 to 120 Hz frame period after the passage of "i" sec from the rising edge. The polarity control signal POL is generated in the substantially same form as the related art polarity control signal.

The liquid crystal cells are charged to the data voltages DATA with the same polarity in each frame period for 1 sec including the plurality of 60 Hz frame periods. During each of the 80 to 120 Hz frame periods that are defined by the inverse periodic signal Tinv and are arranged between the 60 Hz frame periods to be spaced apart from each other, the liquid crystal cells are charged to the data voltage DATA of a previous frame period or a current frame period having a polarity opposite a polarity of the data voltage DATA of the previous frame period, and then are charged to the data voltage DATA with the same polarity as the polarity of the data voltage DATA of the previous frame period. In particular, polarities of the data voltages to which the liquid crystal cells are sequentially charged during a (M+1)-th 80 to 120 Hz frame period are opposite to polarities of the data voltages to which the liquid crystal cells were sequentially charged during an M-th 80 to 120 Hz frame period prior to the (M+1)-th 80 to 120 Hz frame period, where M is a positive integer. Accordingly, while the liquid crystal molecules and the ions of the liquid crystal cells repeatedly move in the opposite direction during the 80 to 120 Hz frame periods when the pulses of the inverse periodic signal Tinv are input, the liquid crystal molecules and the ions of the liquid crystal cells are not polarized.

As a result, in the liquid crystal display and the method of driving the same according to the second exemplary embodiment, because the liquid crystal cells are AC-driven during the 80 to 120 Hz frame period and the ions in the liquid crystal layer move two times in the opposite direction. Hence, the appearance of stains on the display screen can be prevented by suppressing the polarization and accumulation of the ions.

As described above, the liquid crystal display and the method of driving the same according to the exemplary embodiments can suppress the polarization and accumulation of the ions by increasing the frequency of the data voltage, to which the liquid crystal cells are charged at predetermined time intervals, and increasing the number of inverse operations of polarity, thereby preventing the appearance of stains.

It will be apparent to those skilled in the art that various modifications and variations can be made in the embodiments without departing from the spirit or scope of the invention. Thus, it is intended that embodiments of the invention cover the modifications and variations of this invention provided they come within the scope of the appended claims and their equivalents.

What is claimed is:

1. A liquid crystal display comprising:

a liquid crystal display panel including a plurality of liquid crystal cells arranged at crossings of a plurality of data lines and a plurality of gate lines in a matrix format;

a timing signal multiplying circuit that generates a first timing signal and a second timing signal whose frequency is higher than a frequency of the first timing signal;

a frame counter that detects a multiplied frame period to be driven at the frequency of the second timing signal;

a data processing circuit that outputs digital data and allows a frequency of the digital data output during the multiplied frame period to be higher than a frequency of the digital data output during a normal frame period except the multiplied frame period;

a timing control signal generating circuit that generates a polarity control signal for controlling polarities of the digital data;

a polarity control signal inverting circuit that increases a frequency of the polarity control signal to generate an inverse polarity control signal when a frame period is changed from the normal frame period to the multiplied frame period, wherein the frequency of the inverse polarity control signal is decreased when the frame period is changed from the multiplied frame period to the normal frame period;

a data drive circuit that converts the digital data into a data voltage and controls a polarity of the data voltage in response to the inverse polarity control signal; and a gate drive circuit that supplies gate pulses to the gate lines.

2. The liquid crystal display of claim 1, wherein during the multiplied frame period, the data processing circuit outputs digital average data as an average value of data of a previous frame period, and then outputs digital video data to be displayed during a current frame period.

3. The liquid crystal display of claim 1, wherein during the multiplied frame period, the data processing circuit outputs digital average data as an average value of data of a current frame period, and then outputs digital video data to be displayed during the current frame period.

4. The liquid crystal display of claim 1, wherein during the multiplied frame period, the data processing circuit again outputs digital video data, that was output during a previous frame period, and then outputs digital video data to be displayed during a current frame period.

5. The liquid crystal display of claim 1, wherein the data processing circuit successively outputs two times digital video data to be displayed during a current frame period during the multiplied frame period.

6. The liquid crystal display of claim 1, wherein each of the liquid crystal cells is charged to the data voltage with a polarity opposite a polarity of the data voltage, to which the liquid crystal cells were charged during a previous frame period, and then is charged to the data voltage with the same polarity as the polarity of the data voltage of the previous frame period, in one frame period of the multiplied frame period.

7. A method of driving a liquid crystal display including a liquid crystal display panel, having a plurality of liquid crystal cells arranged at crossings of a plurality of data lines and a plurality of gate lines in a matrix format, the method comprising:

generating a first timing signal and a second timing signal whose frequency is higher than a frequency of the first timing signal;

detecting a multiplied frame period to be driven at the frequency of the second timing signal;

outputting digital data and allowing a frequency of the digital data output during the multiplied frame period to be higher than a frequency of the digital data output during a normal frame period except the multiplied frame period;

generating a polarity control signal for controlling polarities of the digital data;

increasing a frequency of the polarity control signal to generate an inverse polarity control signal when a frame period is changed from the normal frame period to the multiplied frame period;

decreasing the frequency of the inverse polarity control signal when the frame period is changed from the multiplied frame period to the normal frame period;

converting the digital data into a data voltage and controlling a polarity of the data voltage in response to the inverse polarity control signal; and supplying gate pulses to the gate lines.

8. The method of claim 7, wherein each of the liquid crystal cells is charged to the data voltage with a polarity opposite a polarity of the data voltage, to which the liquid crystal cells were charged during a previous frame period, and then is charged to the data voltage with the same polarity as the polarity of the data voltage of the previous frame period, in one frame period of the multiplied frame period.

* * * * *